United States Patent [19]

Ford

[11] 4,183,504

[45] Jan. 15, 1980

[54] HIGHWAY SACRIFICIAL BARRIER

[76] Inventor: Frederick Ford, Box 312, Whitefield, N.H. 03598

[21] Appl. No.: 898,281

[22] Filed: Apr. 20, 1978

[51] Int. Cl.[2] ..... E01F 15/00

[52] U.S. Cl. ..... 256/13.1

[58] Field of Search ..... 256/1, 13.1; 52/98; 49/463; 116/63 P; 215/355, 358; 206/45.16; 220/93, DIG. 19, 66, 307, 352; 404/6; 248/158

[56] References Cited

U.S. PATENT DOCUMENTS

| | | | |
|---|---|---|---|
| Re. 29,544 | 2/1978 | Fitch | 256/13.1 |
| 905,652 | 12/1908 | Comings | 215/358 |
| 2,238,233 | 4/1941 | Westrope | 52/718 X |
| 2,497,827 | 2/1950 | Trafton | 220/307 |
| 2,637,462 | 5/1953 | Becker | 220/352 |
| 3,156,372 | 11/1964 | Parker | 220/307 |
| 3,606,258 | 9/1971 | Fitch | 256/13.1 |

*Primary Examiner*—Werner H. Schroeder
*Attorney, Agent, or Firm*—Wolf, Greenfield & Sacks

[57] ABSTRACT

A sacrificial barrier for use along a highway, usually arranged in an array of such barriers for causing a relatively rapid deceleration and stopping of a vehicle to prevent substantial injury to the vehicle and the occupant thereof. The barrier comprises a container body, a new, improved frangible support table within the body and a quantity of a dispersible mass supported on the support table. One or more spacers may be used under the table for barriers designed to maintain a constant center of gravity when using smaller quantities of dispersible mass.

10 Claims, 10 Drawing Figures

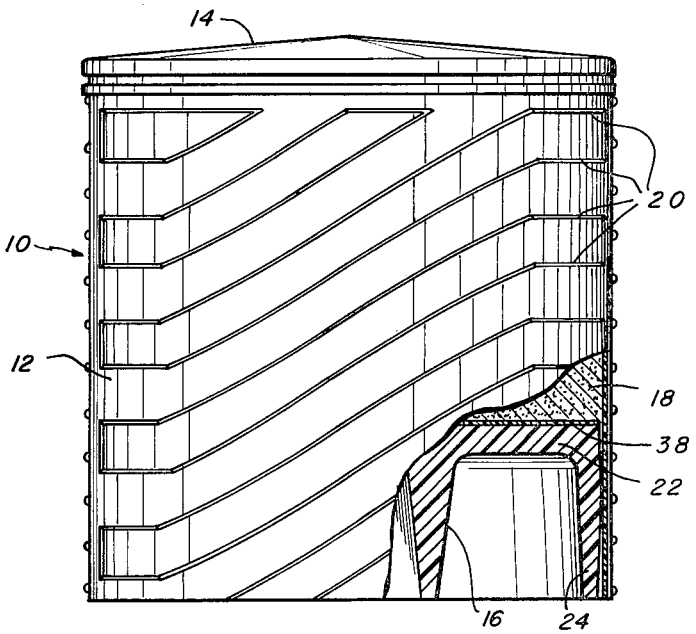
Fig. 1
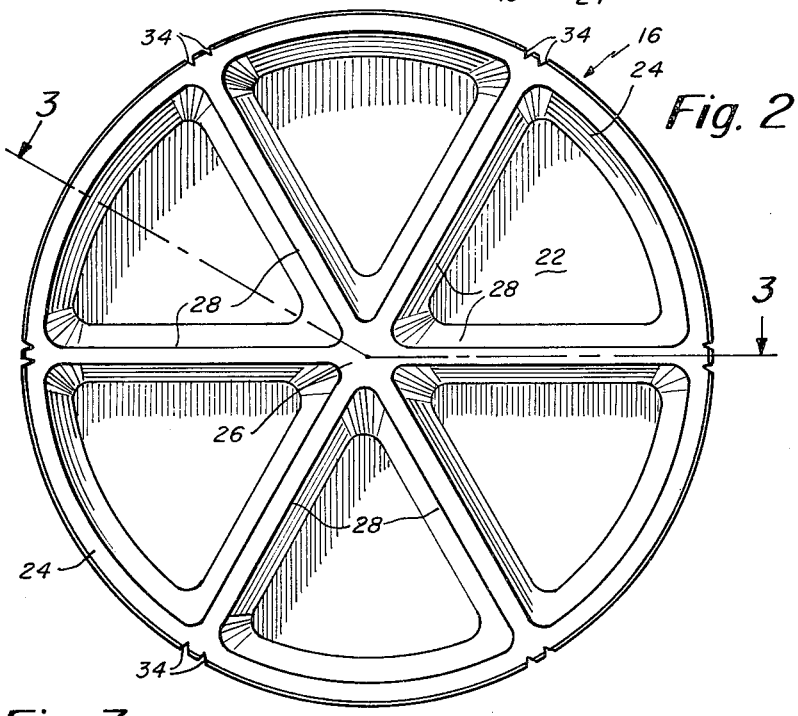
Fig. 2
Fig. 4
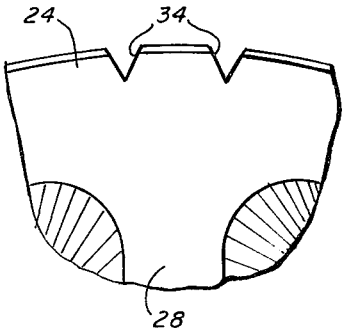
Fig. 3
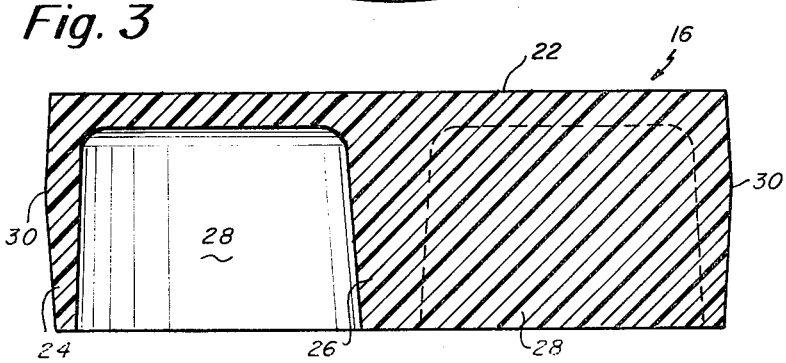

HIGHWAY SACRIFICIAL BARRIER

BACKGROUND OF THE INVENTION

The present invention pertains in general to highway sacrificial safety barriers and relates, more particularly to a sacrificial barrier that is usually disposed in front of a stationary structure to cause a gradual controlled deceleration of the vehicle, preferably within a relatively small distance to prevent the vehicle from contacting the immovable structure. Barriers of this type are typically placed along the highway in front of such structures as bridge supports or other relatively heavy obstructions that might occur along the highway.

With regard to the subject matter of this invention, the following U.S. Pat. Nos. 3,606,258; 3,856,268; 3,643,924; 3,880,404; and 3,916,816 show typical barriers that may be used along a highway. These barriers typically use an outer breakable container that is at least partially filled with a relatively heavy dispersible mass such as sand. The structures are constructed so that the center of gravity of the overall structure is elevated so as to provide optimum resistance to the impact of the vehicle; at the same time preventing any undesired vertical movement of the vehicle when striking the barrier or array of barriers. In this connection, it is important that the vehicle be brought to a stop relatively gradually and without there being any substantial change in the direction or elevation of the vehicle.

One of the prior art arrangements such as shown in U.S. Pat. No. 3,606,258 employs a cylindrical body with a mass of sand disposed inside the body and supported by a core assembly with an impervious plate or top on the core assembly. The core assembly is typically composed of a number of straight sections which are individually arranged in an "egg crate" arrangement. The table construction in the prior art is thus complex to construct the time consuming to construct.

With the prior art barrier arrangement, it has been found, expecially after a relatively long period of time, that the sand in the upper portion of the container tends to leak at one or more places into the bottom secton of the container filling some of the voids in the core assembly thus changing the center of gravity. Also, there may be a tendency for the container to separate from the core assembly. Eventually, it is possible and sometimes common for the barrier to tip over itself especially when sand leakage is unequal, tending to make one side of the container heavier than the other side.

Accordingly, one object of the present invention is to provide an improved highway inertial sacrificial barrier having a container with sand or the like material therein supported by a table structure and wherein there is a friction fit providing an effective seal between the container and the table structure to prevent any leakage of the sand or other dispersible mass.

Another object of the present invention is to provide an improved highway sacrificial inertial barrier wherein no appreciable space is allowed for whatever minute quantity of sand or other dispersible mass may leak between container and table, thus insuring no substantial change in center of gravity of the whole.

Still another object of the present invention is to provide an improved highway sacrificial barrier wherein the container is prevented from riding up on the table primarily because of the friction fit therebetween.

Another object of the present invention is to provide a highway sacrificial inertial barrier that can be quite readily erected even by an unskilled person. This is most important in that many times these barriers must be erected along the highway in a relatively unsafe location. It is desired, therefore, to have a barrier that can be erected quite quickly so that the person erecting the barrier is not subjected to the unsafe condition for any longer period of time than is necessary.

Still a further object of the present invention is to provide a highway sacrificial barrier that is relatively simple in construction, has a table structure that is preferably constructed in a single piece, and that can be manufactured at relatively low cost.

SUMMARY OF THE INVENTION

To accomplish the foregoing and other objects of this invention, there is provided a highway sacrificial barrier that comprises a cylindrical container having disposed at the bottom thereof, a table structure for carrying on the top thereof, a predetermined quantity of a dispersible mass which is preferably sand. This sand is preferred as it is relatively inexpensive and yet provides a substantial weight per volume. The table structure preferably is composed of a flat table top supported by a peripheral cylindrical wall and a center support leg with a plurality of additional supporting legs radiating from the central leg to the cylindrical wall. The cylindrical wall is not perpendicular to the table top, but rather tapers slightly outward for its top half and tapers inward for its lower half. The resulting wedge-shaped peripheral surface provides a friction fit seal with the interior wall of the container. The described structure permits the weight of the sand to force the table into even tighter seal with the container to substantially eliminate any chance of sand leakage from the top of the container to the bottom.

In accordance with the invention, there may also be provided one or more spacers which are used to vary the height of the table within the container. This is a much more advantageous arrangement than the prior art wherein the table structures had to be constructed in different heights rather than taking advantage of the use of a common spacer.

BRIEF DESCRIPTION OF THE DRAWINGS

Numerous other objects, features and advantages of the invention should now become apparent upon a reading of the following detailed description taken in conjunction with the accompanying drawings, in which:

FIG. 1 is a side elevation view of a barrier of this invention with a portion thereof broken away to reveal some of the interior detail;

FIG. 2 is a bottom view of the support table structure for the dispersible mass;

FIG. 3 is a cross-sectional view taken along line 3—3 of FIG. 2;

FIG. 4 is an exploded detail view showing an important feature incorporating the score lines for making this structure more frangible and for locating the radial legs if the table is to be cemented to the spacer prior to final assembly;

DETAILED DESCRIPTION

Figure 5:
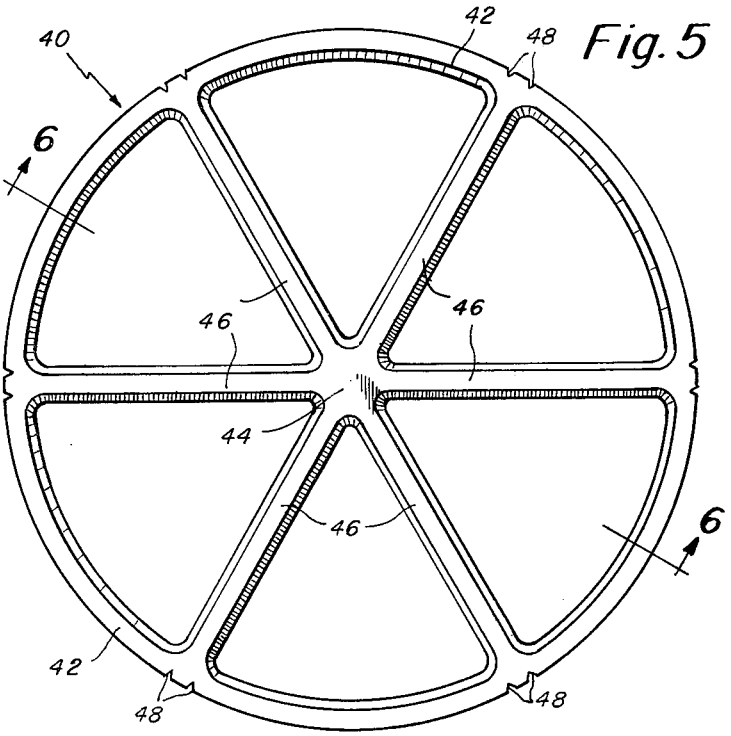
FIG. 5 is a bottom view of a spacer that may be used with the table structure.

FIG. 1 is a side elevation view of a highway sacrificial inertial barrier 10, which comprises a generally cylindrical container 12 having at the top thereof, a snap-fit lid 14. At the bottom of the container 12 there is disposed an internal, light weight, frangible support table structure 16 which supports a predetermined quantity of a dispersible mass 18. The container 12 along with its lid 14 may be constructed from an available material such as a structural foam plastic which may have a density of 45 lbs. per cubic ft. and a tensile strength of 1000 lbs. It is important that this material be relatively durable and weather proof and yet at the same time be capable of being broken into many fragments upon impact by a vehicle. In this connection there are provided a number of spiral indentations 20, each of which in effect forms a line along which the container may break.

The dispersible mass 18 is preferably sand. The sand is preferred as it is relatively inexpensive to buy in large quantities. Furthermore, the sand has a relatively high mass per unit volume. Also, when the container is impacted by a vehicle, the sand will reduce the possibility of fire in the engine compartment of the vehicle.

FIGS. 2–4 show the detail of the table structure 16, which is also preferably made of easily frangible, lightweight foam plastic material, such as a molded expanded polystyrene having a nominal density of about 1.5 lbs. per cubic ft. As depicted in the drawings, the table 16 has a plurality of radially arranged webs 28 which extend from a center hub 26 to the outer cylindrical portion 24. Above the webs 28 there is, integral therewith, the upper support wall 22. This ribbed construction provides relatively strong construction sufficient to retain the weight of the mass 18 without collapsing.

Figure 7:
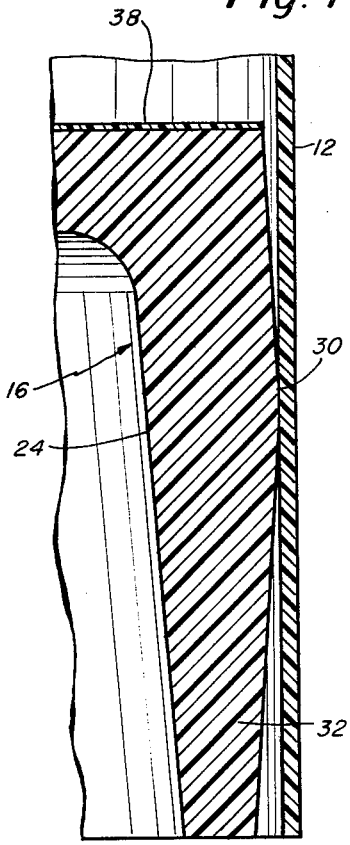
FIG. 7 is an enlarged view and cross-section showing the important friction fit of this invention.

One of the important features of the present invention is probably most clearly depicted in FIG. 7 including a wedge-shaped sealing surface 30 which forms a peripheral seal in a friction-fit arrangement with the interior wall of the container 12. In this way, any sand which may try to escape from the container by leaking through the bottom thereof, will be trapped by this wedge 30 and thus be prevented from falling out of the container. Also, if any sand does leak through this contact point, the amount of space which it can fill is small enough so that no appreciable change in center of gravity of the unit will result. The taper of the lower portion 32 of the cylinder 24 also facilitates insertion of the table 16 into the container 12 during the assembly operation. Actually, because the wedge tapers in both directions, it is easy to insert the table 16 from either direction into the container 12.

As most clearly depicted in FIG. 4 there are also provided score lines 34 which are formed in cylinder 24 directly outwardly of each web 28. These score lines are for enhancing the frangibility of the table structure 16 upon any heavy impact. These score lines perform another function in permitting alignment of radial legs of the spacer and table if pre-assembly is done by cementing the combination prior to final assembly with the outer container.

Figure 6:
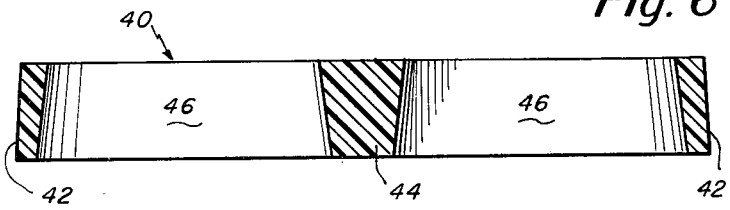
FIG. 6 is a cross-sectional view taken along line 6—6 of FIG. 5.
Figure 8:
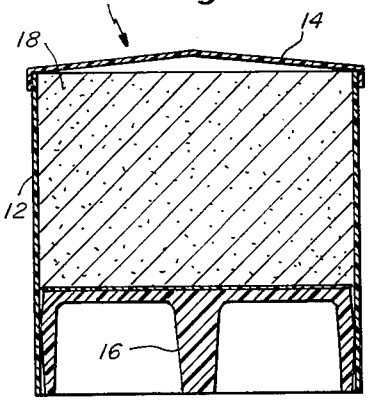
FIGS. 8, 9 and 10 are sectional views of barriers including a support table slone, a support table with one spacer, and a support table with two spacers, respectively.
Figure 9:
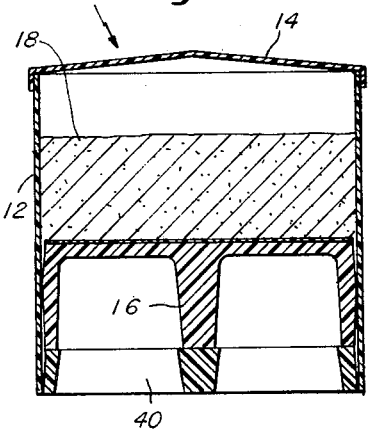
Figure 10:
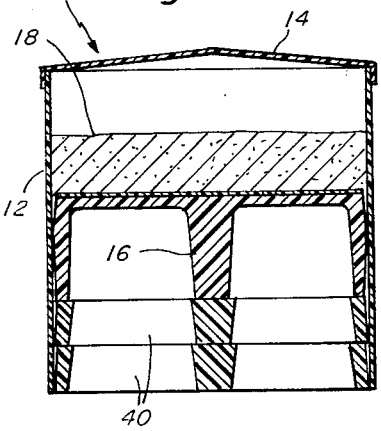

FIGS. 5 and 6 show a bottom view and cross section, respectively of the spacer 40. The spacer 40 is used to elevate the table 16 such as shown in FIGS. 9 and 10. In FIG. 9 one spacer is used and in FIG. 10 two spacers are used. In addition to maintaining at approximately constant height the center of gravity of the barrier, the spacers also reduce the available volume for the dispersible mass 18. Of the three barriers shown in FIGS. 8-10, the barrier in FIG. 8 is placed closest to the obstruction so that this barrier is the last barrier to be hit. The barrier shown in FIG. 10 is placed furthest from the obstruction. It is the first unit that is struck by the vehicle. The barrier shown in FIG. 9 is placed between the other two barriers.

As depicted in FIG. 6, the spacer 40 has a height that is reduced from the height of the table 16. Each spacer that is used has an outer cylindrical portion 42 and a central hub 44 which is interconnected to the outer portion 42 by a plurality of radially disposed spaced webs 46. The peripheral sidewalls of the spacer 40 are tapered as shown in FIG. 6 for ease of placement within the container individually.

On the spacer 40 there are provided a number of circumferentially spaced, vertically oriented score lines 48. These score lines are provided to enhance the frangibility of the structure. Also, the corresponding score lines 48 and 34 function as aligning marks during the assembly of the barrier so that the webs 46 and 28 are properly vertically aligned. This vertical alignment further enhances the frangibility of the total structure. If there is not proper alignment between the webs then the structure is stronger which is undesirable. In the embodiments of FIGS. 9 and 10, the spacers may be stacked upon one another or may be suitably attached such as by being glued together and possibly also glued to the table 16 prior to final assembly on the highway.

The erection of the barrier can occur quite quickly. The table 16 may be inserted into the container 12 from either direction. The space that exists above the table 16 is then filled with sand or other material. Finally, the lid 14 is secured on top of the container 12 to complete the assembly operation.

In the embodiments shown in FIGS. 8–10 the desired weight of the barrier is determined by properly filling the space with proper amount of sand to provide the total weight. For example, with a barrier having a total height of 36" the table 16 may have a height on the order of 11½" and the spacers may each have a height on the order of 5". In the embodiment of FIG. 8 the weight of the barrier when totally filled is approximately 1400 lbs. In FIG. 9 if the space is filled with the sand to a depth of 11½" with the use of a single spacer, then the total weight is 700 lbs. In the embodiment of FIG. 10 when 6½" of sand depth are used with two spacers, then the total weight is on the order of 400 lbs.

One of the important features of the present invention is probably most clearly depicted in FIG. 7 employing a wedge-shaped outer peripheral wall on the table which enables a tight contact between the table and the container.

Having described a limited number of embodiments of this invention, it should now become apparent to those skilled in the art that numerous other embodiments and modifications of the ones disclosed herein are contemplated as falling within the spirit and scope of this invention.

What is claimed is:

1. A sacrificial inertial barrier assembly comprising:

an outer, frangible container, a frangible support table within said container, p1 a dispersible mass also within said container, said table having an upper wall for supporting said mass, the improvement comprising said table having means defining a continuous, circumferential outer sealing surface which is wedge-shaped in a vertical cross-section, said table having its maximum circumference at said sealing surface and a gradually reduced circumference above and below said sealing surface, said surface being frictionally engageable with the interior wall of said container and compressible thereagainst whereby migration of any portion of said dispersible mass between said container wall and said sealing surface is effectively negated.

2. A sacrificial inertial barrier assembly comprising:

an outer frangible container, a frangible support table within said container, a dispersible mass also within said container, said table having an upper wall for supporting said mass, the improvement comprising said table having means defining a continuous, circumferential outer sealing surface which is wedge-shaped in a vertical cross-section, said surface being frictionally engageable with the interior wall of said container and compressible thereagainst whereby migration of any portion of said dispersible mass between said container wall and said sealing surface is effectively negated, said table further comprising means defining a plurality of vertically oriented score lines in said sealing surface to enhance the frangibility of said table.

3. A sacrificial inertial barrier assembly comprising:

an outer frangible container, a frangible support table within said container, a dispersible mass also within said container, said table having an upper wall for supporting said mass, the improvement comprising said table having means defining a continuous, circumferential outer sealing surface which is wedge-shaped in a vertical cross-section, said surface being frictionally engageable with the interior wall of said container and compressible thereagainst whereby migration of any portion of said dispersible mass between said container wall and said sealing surface is effectively negated, at least one modular spacer fitted within said container beneath said table for elevating said table to regulate the center of gravity of the dispersible mass.

4. A sacrificial inertial barrier assembly as set forth in claim 3 wherein said table and spacer comprises an outer cylinder a central hub, and a plurality of radially disposed webs joining said hub and cylinder.

5. A sacrificial inertial barrier assembly as set forth in claim 4 wherein the plurality of webs of the spacer and table are the same in number and orientation, the sealing surface being formed on the external surface of the outer cylinder of the table, said outer cylinder also being provided with a plurality of vertically oriented score lines which, when aligned, with the score lines at the spacer cause the webs of said table and spacer to be vertically aligned, whereby the frangibility of said table and spacer is enhanced by both the said vertical alignment of said webs and the provision of said score lines.

6. A support structure for use in a sacrificial inertial barrier, having an essentially cylindrical container adapted to contain a dispersible mass, the improvement comprising:

a lightweight frangible support table, said table having an upper wall for supporting said mass, said table having means defining a continuous, circumferential outer sealing which is wedge-shaped when viewed in vertical cross-section, said table having its maximum circumference at said sealing surface and a reduced circumference above and below said sealing surface, said surface being frictionally engageable throughout its circumferential extent with the interior of said container and compressible thereagainst whereby migration of any portion of said dispersible mass between said container wall and said sealing surface is effectively negated.

7. A support structure for use in a sacrificial inertial barrier, having an essentially cylindrical container adapted to contain a dispersible mass, the improvement comprising:

a lightweight frangible support table, said table having an upper wall for supporting said mass, said table having means defining a continuous, circumferential outer sealing surface which is wedge-shaped when viewed in vertical cross-section, said surface being frictionally engageable throughout its circumferential extent with the interior of said container and compressible thereagainst whereby migration of any portion of said dispersible mass between said container wall and said sealing surface is effectively negated, at least one modular spacer beneath said table for elevating said table.

8. A support structure as set forth in claim 7 wherein both said table and modular spacer have an outer cylinder, a central web, and a plurality of radially arranged webs joining said hub and cylinder.

9. A support structure for use in a sacrificial inertial barrier having an essentially cylindrical container adapted to contain a dispersible mass, the improvement comprising said support structure for maintaining the mass at an elevated position within said container including a frangible support table having an upper surface for supporting said mass and an outer peripheral edge that friction fits with the internal surface of the container, said table having its maximum circumference at said outer peripheral edge and a reduced circumference both above and below said peripheral edge.

10. A support structure for use in a sacrificial inertial barrier having an essentially cylindrical container adapted to contain a dispersible mass, the improvement comprising said support structure for maintaining the mass at an elevated position within said container including a frangible support table having an upper surface for supporting said mass and an outer peripheral edge that friction fits with the internal surface of the container, at least one modular spacer disposed in the container below the support structure for elevating the support structure.

* * * * *